US006023404A

United States Patent [19]

Marmonier

[11] Patent Number: 6,023,404

[45] Date of Patent: Feb. 8, 2000

[54] METHOD OF MONITORING AND DIAGNOSING THE OPERATION OF HIGH VOLTAGE ELECTRICAL APPARATUS

[75] Inventor: Jean Marmonier, Aix les Bains, France

[73] Assignee: GEC Alsthom T & D SA, Paris, France

[21] Appl. No.: 09/089,443

[22] Filed: Jun. 3, 1998

[30] Foreign Application Priority Data

Jun. 4, 1997 [FR] France ..... 97 06880

[51] Int. Cl.[7] ..... H01H 71/04

[52] U.S. Cl. ..... 361/116; 361/14

[58] Field of Search ..... 361/14, 102, 115, 361/116, 120, 123; 324/514, 515, 424; 364/528.36, 528.37; 702/33, 34, 94, 98, 114, 138, 140, FOR 104, FOR 111, FOR 143

[56] References Cited

U.S. PATENT DOCUMENTS

| | | | |
|---|---|---|---|
| 4,864,286 | 9/1989 | Ohshita et al. | 340/644 |
| 5,629,869 | 5/1997 | Johnson et al. | 702/34 |

FOREIGN PATENT DOCUMENTS

| | | | |
|---|---|---|---|
| WO9323760 | 11/1993 | WIPO | G01R 31/02 |
| WO9528025 | 10/1995 | WIPO | H02J 5/00 |
| WO9636982 | 11/1996 | WIPO | H01H 33/66 |

OTHER PUBLICATIONS

R. Jeanjean et al. "Electronic System for Controlling and MOnitoring the Mechanical and Electrical Integrity of HV Circuit Breakers", Aug. 28, 1988, ULSI Science And Technology 1987.

*Primary Examiner*—Ronald W. Leja

*Attorney, Agent, or Firm*—Sughrue, Mion, Zinn, Macpeak & Seas, PLLC

[57] ABSTRACT

During opening or closing of the apparatus, in particular a circuit breaker while it is electrically isolated, the method consists in:

i) recording a signal representative of the variation over time of the pressure inside the interrupter chamber by means of a sensor disposed outside the interrupter chamber and mounted to be in communication with the gas under pressure inside said chamber;

ii) recording a signal representative of the variation over time of the position of the moving contact by means of a sensor disposed outside the interrupter chamber and mounted to detect movement of a drive rod; and iii) comparing the above signals with corresponding signals representative of reference operation of the high voltage electrical apparatus for the purpose of monitoring proper operation thereof or of detecting faulty operation of the electrical apparatus, particularly in the event of a valve in the interrupter chamber of the circuit breaker becoming jammed.

3 Claims, 3 Drawing Sheets

METHOD OF MONITORING AND DIAGNOSING THE OPERATION OF HIGH VOLTAGE ELECTRICAL APPARATUS

FIELD OF THE INVENTION

The invention relates to a method of monitoring and diagnosing the operation of high voltage electrical apparatus which includes contacts inside an interrupter chamber containing a gas under pressure, with at least one of the contacts being a moving contact which is moved by a drive rod.

The invention relates more particularly to monitoring and diagnosing the operation of so-called "new generation" circuit breakers that require low control energy, and it can be applied to other apparatuses such as a disconnector or a grounding disconnector if such apparatuses use technology similar to that of so-called "new generation" circuit breakers.

BACKGROUND OF THE INVENTION

Until now, to monitor the operation of the active portion of a circuit breaker, the interrupter chamber has been disassembled, thereby taking the circuit breaker out of operation for a certain length of time.

OBJECT AND SUMMARY OF THE INVENTION

The object of the invention is to provide a non-intrusive method of monitoring and diagnosing the operation of a circuit breaker, i.e. a method that does not require the interrupter chamber thereof to be disassembled.

To this end, the invention provides a method of monitoring and diagnosing the operation of a high voltage electrical apparatus comprising contacts inside an interrupter chamber containing gas under pressure, at least one of the contacts being a movable contact that is moved by a drive rod, the method consisting in the following, performed on opening or closing the apparatus while it is electrically isolated:

i) recording a signal representing the variation over time of the pressure inside the interrupter chamber by means of a sensor disposed outside the interrupter chamber and mounted to be in communication with the gas under pressure inside said chamber; and ii) comparing the above signal with a corresponding signal representative of reference operation of the high voltage electrical apparatus for the purpose of monitoring proper operation thereof or of detecting faulty operation of the electrical apparatus.

By way of example, faulty operation may be the result of a valve of the circuit breaker interrupter chamber jamming in an open position or in a closed position, or it may result from an abnormally high mechanical shock being applied to the moving contact during opening or closing of the circuit breaker.

Advantageously, in the method of the invention, in addition to recording the signal representing the variation over time of the pressure, a signal representing the variation over time of the displacement of the moving sensor is recorded by means of a sensor disposed outside the interrupter chamber and mounted to detect displacement of the drive rod.

Simultaneously recording both the pressure signal and the displacement signal makes it possible to detect faulty operation more reliably, with the signal representing displacement serving to confirm a diagnosis based on the signal representing pressure.

BRIEF DESCRIPTION OF THE DRAWINGS

Other characteristics and advantages of the invention appear on reading the description of an implementation of the method of the invention as illustrated by the drawings.

MORE DETAILED DESCRIPTION

Figure 1:
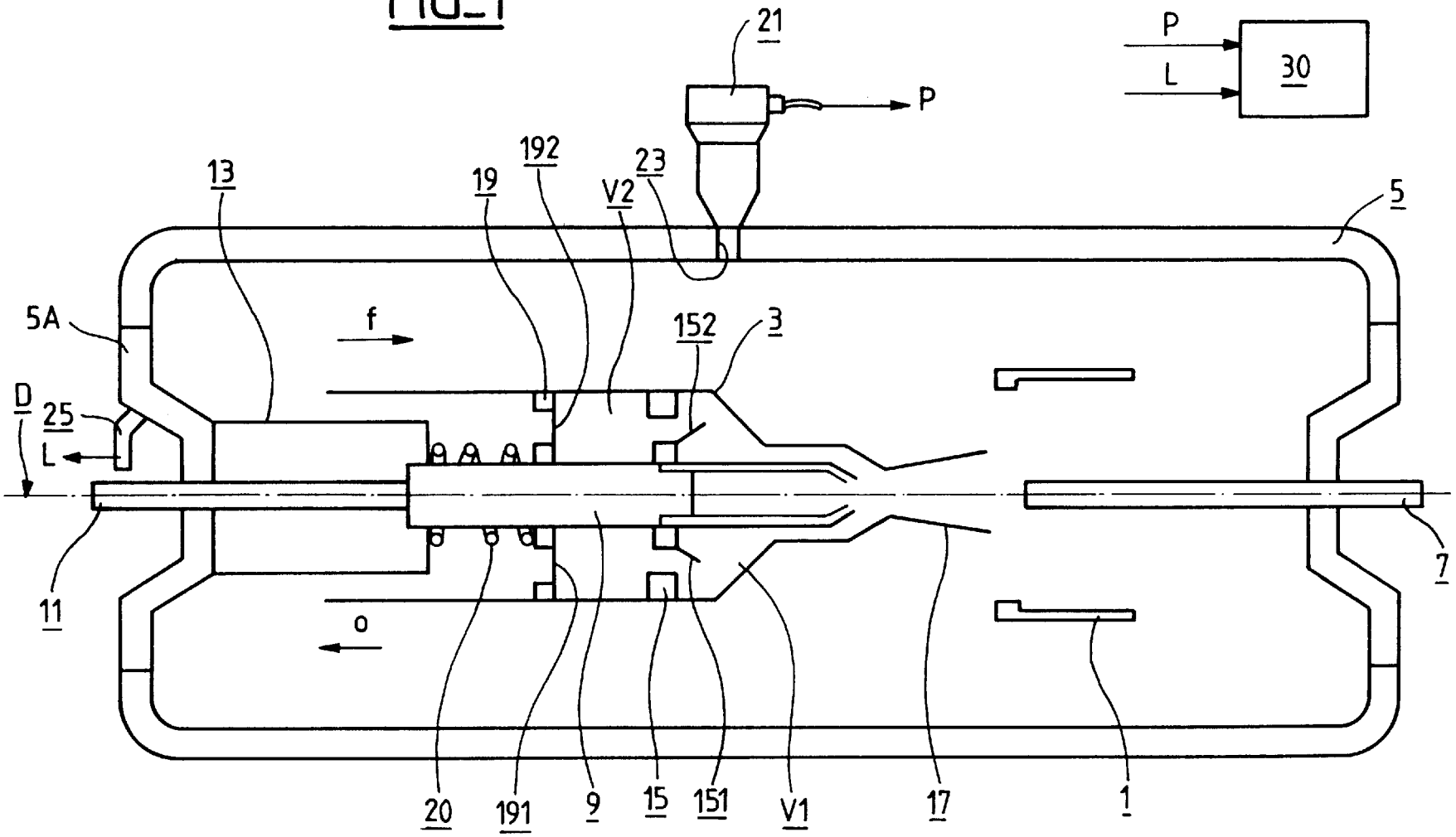
FIG. 1 shows an interrupter chamber in crosssection together with a pressure sensor and a position sensor mounted on the outside of the chamber.

In FIG. 1, a so-called "new generation" circuit breaker requiring low control energy comprises an interrupter chamber defined by a leakproof envelope 5 filled with a dielectric gas such as $SF_6$ at a pressure of a few bars and containing a fixed tubular main contact 1 which co-operates with a moving tubular main contact 3, the contact 3 being movable along an axial direction D. The fixed main contact 1 is secured to a fixed arcing contact 7 which co-operates with a moving arcing contact 9 secured to the moving main contact 3. The moving contacts 3 and 9 are moved along direction D by a drive rod 11 which leaves the envelope 5 via its end 5A. The drive rod is guided in sliding by a support block 13 mounted stationary inside the envelope and bearing against the end wall 5A.

The moving main contact 3 and the moving arcing contact 9 are coaxial and extend parallel to the longitudinal direction D. A front ring 15 is disposed between the moving contacts 3 and 9 in a plane perpendicular to the longitudinal direction D. It holds the moving contacts 3 and 9 together and it opens via valves 151 and 152 into a blast volume V1 that is closed by a blast nozzle 17.

A rear ring 19 is disposed between the moving contacts 3 and 9 in a plane perpendicular to the longitudinal direction D. It slides relative to the two moving contacts and it opens via two valves 191 and 192 to a compression-and-suction volume V2 that is closed by the front ring 15.

A spring 20 has one end bearing against the support block 13 and its other end bearing against the face of the rear ring 19 which does not carry the valves 191 and 192.

The method of the invention implements a first sensor which provides information concerning variation over time in the pressure that is obtained inside the interrupter chamber during opening or closing of the circuit breaker.

In FIG. 1, a pressure sensor 21 for recording variation over time of the pressure in the interrupter chamber is constituted, for example, by a resilient diaphragm sensor.

Advantageously, a temperature-compensated pressure sensor is used which senses pressure during rapid changes of pressure inside the interrupter chamber by means of the thermal inertia of such a sensor, and which also makes it possible to monitor the density of the dielectric gas 6. The pressure sensor is fixed to the outside of the metal envelope 5 of the circuit breaker. The gas 6 present in the interrupter chamber is put into communication with the pressure sensor 21 via a duct 23 formed through the thickness of the metal envelope 5.

In a particularly advantageous implementation, the method of the invention also makes use of a second sensor which records variation over time in the position of the moving contact(s) during opening or closing of the circuit breaker.

In FIG. 1, a position sensor 25 for recording variation over time in the position of the moving contact(s) inside the interrupter chamber is constituted, for example, by an optical cell, or by an inductive displacement sensor, or by a Hall effect sensor. It is fixed outside the metal envelope 5, e.g. on the end wall 5A of the envelope to detect displacement of the rod 11 along the direction D.

The signals P and L produced by the pressure and position sensors 21 and 25 are supplied to a unit 30. The unit 30 may be a display and/or data processor unit. By comparing the signals P and L recorded during an operation of opening and closing a circuit breaker that is electrically isolated with reference recordings, it is possible to monitor the proper operation or to detect faulty operation of the circuit breaker, as explained below.

Figure 2A:
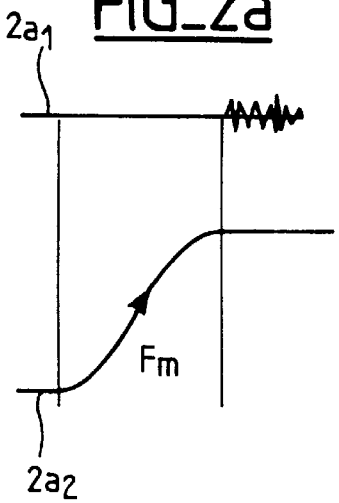
FIGS. 2*a* and 2*b* show a recording of pressure and a recording of position corresponding to reference operation of a circuit breaker, respectively during closing and during opening.

In FIG. 2*a*, reference operation on closure of the circuit breaker gives rise to a reference pressure recording $\mathbf{2}a_1$ of flat shape, and to a reference position recording $\mathbf{2}a_2$ in the form of a rising ramp as represented by arrow $F_m$.

During closing, the compression-and-suction volume V2 is initially zero, since the front and rear rings 15 and 19 are in contact. The pressure recording $\mathbf{2}a_1$ is explained by the fact that displacement of the moving contact 9 in the direction indicated by arrow f in FIG. 1 causes the valves 191 and 192 of the rear ring 19 to open and thus allow the dielectric gas to flow freely such that no suction is established inside the interrupter chamber. At the end of the stroke, the valves close leaving the circuit breaker ready for opening.

It should be observed that the recording $\mathbf{2}a_1$ terminates in relatively fast oscillations of the pressure representing the soundwave generated by the mechanical shock of the moving main contact 3 striking the fixed main contact 1.

Figure 2B:
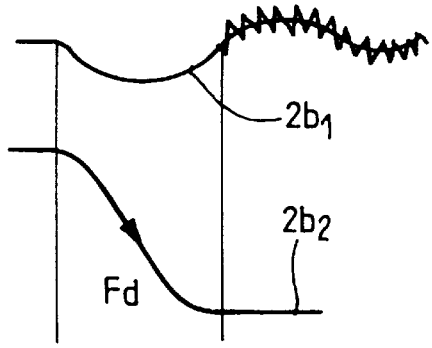

In FIG. 2*b*, reference operation during opening of the circuit breaker gives rise to a reference pressure recording $\mathbf{2}b_1$, that is curved, and to a reference position recording $\mathbf{2}b_2$ that is in the form of a downward slope, as indicated by arrow $F_d$.

During opening, the compression-and-suction volume V2 is initially at a maximum value, with the front and rear rings 15 and 19 being separated by a maximum distance. The pressure recording $\mathbf{2}b_1$ can be explained by the fact that the displacement of the moving contact 9 in the direction indicated by arrow o in FIG. 1 is accompanied by compression of the gas contained in the compression-and-suction volume V2 which corresponds to suction in the interrupter chamber, and to compression of the gas in the blast volume V1 defined by the blast nozzle 17. At about half-stroke, the valves 151 and 152 of the front ring 15 open to equalize the gas pressure in the two volumes constituted by the compression-and-suction volume V2 and the blast volume V1, thus allowing a fraction of the compressed gas to escape via the blast nozzle to blow out any electric arc that may have formed in the event of opening taking place on a load.

It should be observed that recording $\mathbf{2}b_1$, terminates in relatively fast oscillations superimposed on a slower oscillation of the pressure representing the soundwave generated by the mechanical shock between the front ring 15 and the rear ring 19.

FIGS. 3*a*, 4*a*, 5*a*, and 6*a* are pressure and position recordings on closure of a circuit breaker that is being monitored. FIGS. 3*b*, 4*b*, 5*b*, and 6*b* are pressure and position recordings during opening of said circuit breaker that is being monitored. These recordings show up faulty operation of the circuit breaker.

Figure 3A:
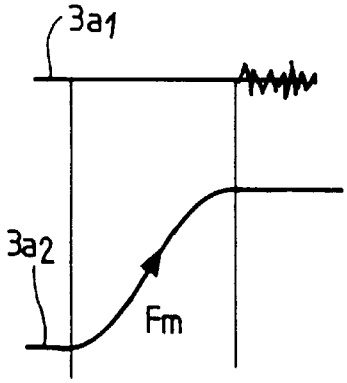
FIGS. 3*a* and 3*b* show faulty operation of the circuit breaker attributed to valves located in the rear ring of the circuit breaker being jammed in the open position, respectively during closing and during opening.
Figure 3B:
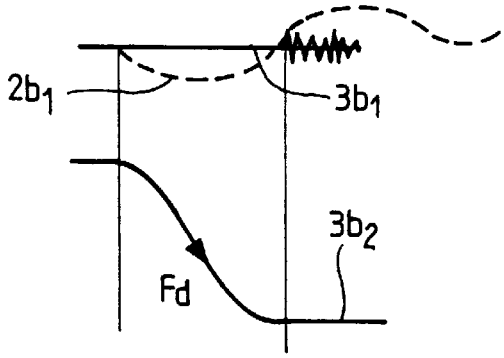

Thus, in FIG. 3*a*, closure of the circuit breaker that is being monitored gives rise to a pressure recording $\mathbf{3}a_1$ and to a position recording $\mathbf{3}a_2$ similar to the reference recordings $\mathbf{2}a_1$ and $\mathbf{2}a_2$. In contrast, in FIG. 3*b*, opening of the circuit breaker that is being monitored gives rise to a pressure recording $\mathbf{3}b_1$ that differs from the pressure recording $\mathbf{2}b_1$ as shown by a dashed line, while the position recording $\mathbf{3}b_2$ is similar to the reference recording $\mathbf{2}b_2$. The difference between the recordings $\mathbf{2}b_1$ and $\mathbf{3}b_1$ represents the valves 191 and 192 in the rear ring 19 being jammed in the open position. This difference can easily be detected automatically by a program in the data processor unit 30.

Figure 4A:
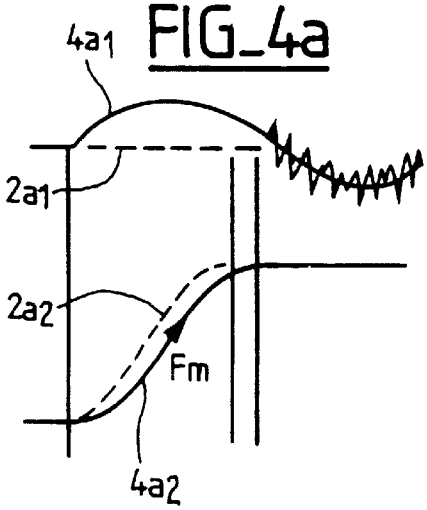
FIGS. 4*a* and 4*b* show faulty operation of the circuit breaker attributed to valves located on a rear ring of the circuit breaker being jammed in the closed position respectively during closing and during opening.
Figure 4B:
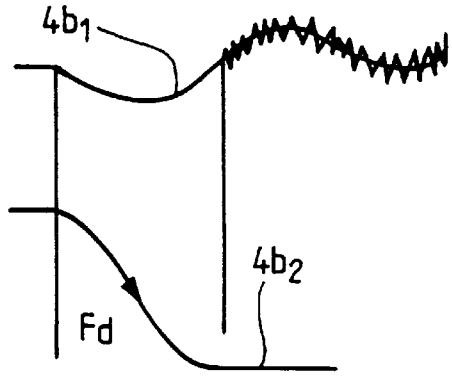

FIGS. 4*a* and 4*b* show faulty operation of the circuit breaker attributed to the valves 191 and 192 of the rear ring 19 being jammed in the closed position. These figures also show the reference recordings as dashed lines. It can be seen that faulty operation is detected by detecting a difference between recordings $\mathbf{4}a_1$ and $\mathbf{2}a_1$, and between recordings $\mathbf{4}a_2$ and $\mathbf{2}a_2$.

It should be observed that during closing, position recording $\mathbf{4}a_2$ represents the existence of a large retaining force exerted by suction created in the compression-and-suction volume V2, and it serves to confirm the diagnosis of the valves 191 and 192 jamming in the closed position.

Figure 5A:
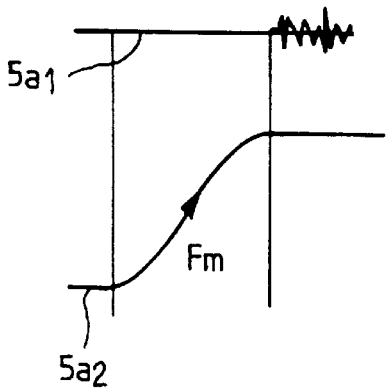
FIGS. 5*a* and 5*b* show faulty operation of the circuit breaker attributed to valves located on a front ring of the circuit breaker jamming in an open position, respectively during closing and during opening.
Figure 5B:
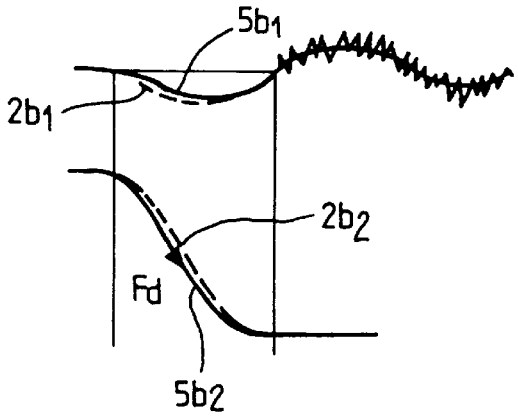

FIGS. 5*a* and 5*b* show faulty operation of the circuit breaker attributed to the valves 151 and 152 of the front ring 15 jamming in the open position. It can be seen that faulty operation is detected by detecting a difference between recordings $\mathbf{5}b_1$ and $\mathbf{2}b_1$, and between recordings $\mathbf{5}b_2$ and $\mathbf{2}b_2$.

Figure 6A:
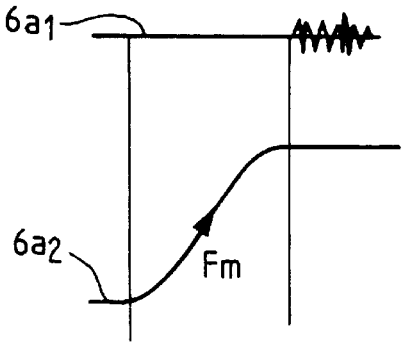
FIGS. 6*a* and 6*b* show faulty operation of the circuit breaker attributed to valves located on a front ring of the circuit breaker jamming in the closed position, respectively during opening, and closing.
Figure 6B:
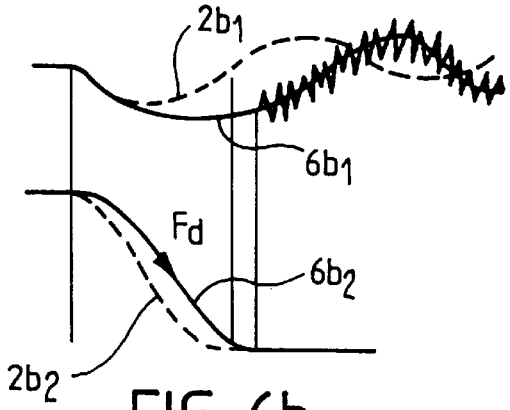

FIGS. 6 and 6*b* illustrate faulty operation of the circuit breaker attributed to the valves 151 and 152 of the front ring jamming in the closed position. It can be seen that faulty operation is detected by detecting a difference between the recordings $\mathbf{6}b_1$ and $\mathbf{2}b_1$, and between recordings $\mathbf{6}b_2$ and $\mathbf{2}b_2$.

Here again it should be observed that during opening, position recording $\mathbf{6}b_2$ shows the existence of a large retaining force exerted by compression created in the compression-and-suction volume V2 and serves to confirm the diagnosis that the valves 151 and 152 have jammed in the closed position.

It will thus be understood that the method of the invention makes it possible to localize the faulty element of the circuit breaker if reference is made to FIGS. 3*a*–3*b* to 6*a*–6*b*. These figures show typical recordings of variations over time that can vary as a function of the topology of the circuit breaker or of the high voltage electrical apparatus.

Also, analyzing the frequency and the amplitude of the oscillations in the pressure recordings at the end of or during opening or closing of the circuit breaker makes it possible to monitor normal mechanical shock or to diagnose a mechanical shock that is abnormally high between the moving and fixed contacts or between the front and rear rings.

Figure 7A:
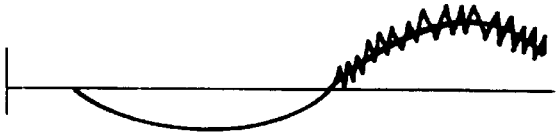
FIGS. 7*a* to 7*c* show a pressure recording representative of a mechanical shock that is respectively: normal, abnormally high at the end of opening, and abnormally low during opening of the circuit breaker.
Figure 7B:
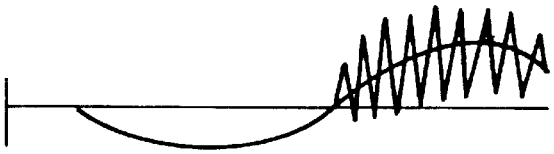
Figure 7C:
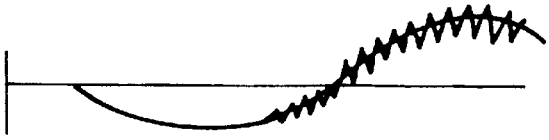

FIG. 7*a* is a pressure recording representing a normal mechanical shock during reference operation of the circuit breaker. FIGS. 7*b* and 7*c* are given as examples of pressure recordings which, when compared with the above recording, represent respectively a mechanical shock that is abnormally high at the end of opening, and a mechanical shock or vibration that is abnormal during opening.

I claim:

1. A method of monitoring and diagnosing the operation of a high voltage electrical apparatus while electrically isolated from a high voltage network, which includes an interrupter chamber filled with a dielectric gas under pressure, which apparatus is fitted with a pressure sensor disposed on the outside of said chamber and mounted to communicate with the dielectric gas under pressure inside said chamber, the chamber containing contacts at least one of which is a moving contact that is moved by a drive rod, said method comprising:

measuring the pressure of said dielectric gas through the pressure sensor communicating directly with said chamber to obtain a pressure signal; and comparing the pressure signal, which is indicative of the pressure of said dielectric gas as measured by the pressure sensor, with a signal representative of a reference operation of the high voltage electrical apparatus, wherein the pressure signal is recorded during movement of said moving contact so as to be representative of a variation over time of the pressure of the dielectric gas inside the interrupter chamber during opening or closing of the contacts of the high voltage electrical apparatus.

2. The method according to claim 1, further comprising:

recording a signal representative of the variation over time in the position of the moving contact, by means of a sensor disposed outside the interrupter chamber and mounted to detect movement of the drive rod, and in comparing said signal with a corresponding signal representative of a reference operation of the high voltage electrical apparatus.

3. The method according to claim 1, further comprising:

analyzing pressure oscillations in the signal representative of a variation over time in the pressure inside the interrupter chamber for the purpose of monitoring or diagnosing mechanical shocks between elements of the apparatus.

* * * * *